US006041527A

United States Patent [19]

Hostetler

[11] Patent Number: 6,041,527

[45] Date of Patent: Mar. 28, 2000

[54] BIDIRECTIONAL DREDGE APPARATUS

[75] Inventor: Craig L. Hostetler, Glendive, Mont.

[73] Assignee: SRS Crisafulli, Inc., Glendive, Mont.

[21] Appl. No.: 09/055,620

[22] Filed: Apr. 6, 1998

[51] Int. Cl.[7] ..... B63B 21/50; E02D 17/16

[52] U.S. Cl. ..... 37/345; 37/307

[58] Field of Search ..... 37/307, 337, 342, 37/343, 345, 317, 324, 326, 329

[56] References Cited

U.S. PATENT DOCUMENTS

| | | | |
|---|---|---|---|
| 319,352 | 6/1885 | Trahern . | |
| 503,734 | 8/1893 | Bates . | |
| 896,892 | 8/1908 | Clemow . | |
| 2,662,310 | 12/1953 | Villota | 37/342 |
| 2,765,548 | 10/1956 | Glaser | 37/343 |
| 2,851,176 | 9/1958 | Stewart | 214/102 |
| 3,521,387 | 7/1970 | Degelman | 37/66 |
| 3,738,029 | 6/1973 | Harmon | 37/329 |
| 4,073,078 | 2/1978 | Leitz | 37/77 |
| 5,060,404 | 10/1991 | Lipford | 37/64 |
| 5,203,099 | 4/1993 | Naranjo et al. | 37/329 |
| 5,286,384 | 2/1994 | Haag | 210/527 |
| 5,638,620 | 6/1997 | Van Der Kooy | 37/338 |

OTHER PUBLICATIONS

Pamphlet: Why can we guarantee a Sludge Removal System that fits your needs? by: SRS Crisafulli, Crisafulli Drive, P.O. Box 1051, Glendive, MT 59330–1051 U.S.A., (6 pp.).

*Primary Examiner*—Eileen Dunn Lillis
*Assistant Examiner*—Gary S. Hartmann
*Attorney, Agent, or Firm*—Weingarten, Schurgin, Gagnebin & Hayes LLP

[57] ABSTRACT

A bidirectional dredge provides active dredging on both forward and reverse passes across an area being dredged. The dredge includes a pivot turning mechanism that allows a turnaround of the dredge, allowing each pass to start at the terminating point of the previous pass. The dredge is driven by a winch attached to an overhead cable strung between the perimeter of the dredging area. The winch is mounted on a pivot mechanism which is operative to rotate the dredge at each end of a dredging pass. The pivot mechanism includes a pair of plates which rotate, a lower plate being attached to the dredge, and an upper plate attached to the winch. At the end of each pass, the pivot unit is activated and the dredge rotated. Following rotation, the dredge is now facing forward toward the distal end of the dredging area, and ready to effect an active dredging pass in the opposite direction, thereby utilizing every pass over the area for active dredging.

4 Claims, 6 Drawing Sheets

BIDIRECTIONAL DREDGE APPARATUS

CROSS REFERENCE TO RELATED APPLICATIONS

N/A

STATEMENT REGARDING FEDERALLY SPONSORED RESEARCH OR DEVELOPMENT

N/A

BACKGROUND OF THE INVENTION

Dredges are often used when removing solids or semi-solids such as sludge, slurries and sediment from the bottom of a body of water. Such dredges mechanically agitate and pump material settled on the bottom of such a body of water. In order to be effective, dredges must move across the surface of the area to be dredged. This area may have varying depths, with varying bottom firmness, complicating the use of typical propeller or track propulsion methods.

Traditional dredging apparatus traverse an area to be dredged by a series of parallel, linear sweeps of the dredging area. Each traversal entails movement of the dredge in a forward direction while actively dredging material from the bottom, then reversing the dredge by passively drawing it backwards over the path just dredged. Material is not dredged during the passive return trip as dredging only occurs in the forward direction of travel. Each parallel traversal of the area occurs laterally displaced from the previous traversal by a distance approximately the same as the width of the dredging head. In this manner, a dredge makes a series of passes back and forth across the area to be dredged while slightly displacing each pass from the previous one to effect full coverage of the area to be dredged.

Further, even when depth conditions permit underwater coverage of the area to be dredged.

Further, even when depth conditions permit underwater propulsion, continuous forward movement is constrained by the turning radius afforded by the propeller or drive mechanism. Accordingly, it may be difficult to effect a series of parallel, linear dredging passes to ensure complete and non-redundant coverage of the bottom area.

An overhead propulsion mechanism attached to a cable or other suspension above the water surface and anchored to mounting points on the perimeter of the dredging area can provide a propulsion mechanism. This arrangement powers the dredge without requiring propulsion apparatus to accommodate variations in depth and solidity beneath the surface.

A typical overhead propulsion system for such dredges comprises a winch attached to an overhead cable. The winch draws the dredge across the dredging area, then reverses and draws the dredge back. However, as the dredging operation only occurs in one direction, the return pass does not effect any removal of material. After an active dredging pass, the dredge passively returns to the starting side. As the return pass of the dredge does not effect further removal of material to be dredged, the number of passes which need be made is increased approximately twofold. It would be beneficial to provide a dredging machine capable of active dredging in both directions across an area to be dredged.

BRIEF SUMMARY OF THE INVENTION

The present invention comprises an overhead propelled dredge operative to provide active dredging on both forward and reverse passes across an area being dredged. The novel dredge includes a pivot mechanism that allows a zero radius turnaround of the dredge, allowing each pass to start at the terminating point of the previous pass.

In accordance with a preferred embodiment, a dredge is driven by a winch attached to an overhead cable strung between laterally moveable mountings on the perimeter of the dredging area. The winch is mounted on a pivot mechanism which is operative to rotate the dredge 180 degrees at each end of a dredging pass. The pivot mechanism in one embodiment includes a pair of plates which rotate with respect to each other, a lower plate being attached to the frame of the dredge, and the upper plate attached to the winch. A pivot drive unit in communication with a gear on a shaft through the plates provides rotational movement of the lower plate with respect to the upper plate, which effects movement of the dredge coupled to the rotating lower plate.

At the start of a dredging pass, the dredge is drawn by the winch across the dredging area in the direction of the cable. Dredged material is pumped through a discharge line. At the end of the pass, the pivot drive unit is activated and the lower plate, along with the dredge, is rotated 180 degrees with respect to the upper plate. Rotation is such that the dredge does not interfere with or pass over the discharge line. A pair of lateral pivot arms extends along the cable length to absorb rotational torque which would otherwise be applied to the winch, possibly misaligning and/or twisting the cable.

At the completion of the rotation, the dredge is now facing forward toward the distal end of the dredging area, and ready to effect an active dredging pass in the opposite direction, thereby utilizing every pass over the area for active dredging.

DETAILED DESCRIPTION OF THE INVENTION

In accordance with the preferred embodiment, a dredge is propelled across an area to be dredged in a series of transverse passes. Each successive pass is displaced laterally from the previous so as to effect compete coverage of the area. A winch attached to the dredge frame guides the dredge along an overhead transverse cable. The cable is attached to movable cable anchor points on opposed sides of the area to be dredged. Lateral movement is effected by displacing anchor points in a substantially parallel manner along the opposed sides.

Figure 1:
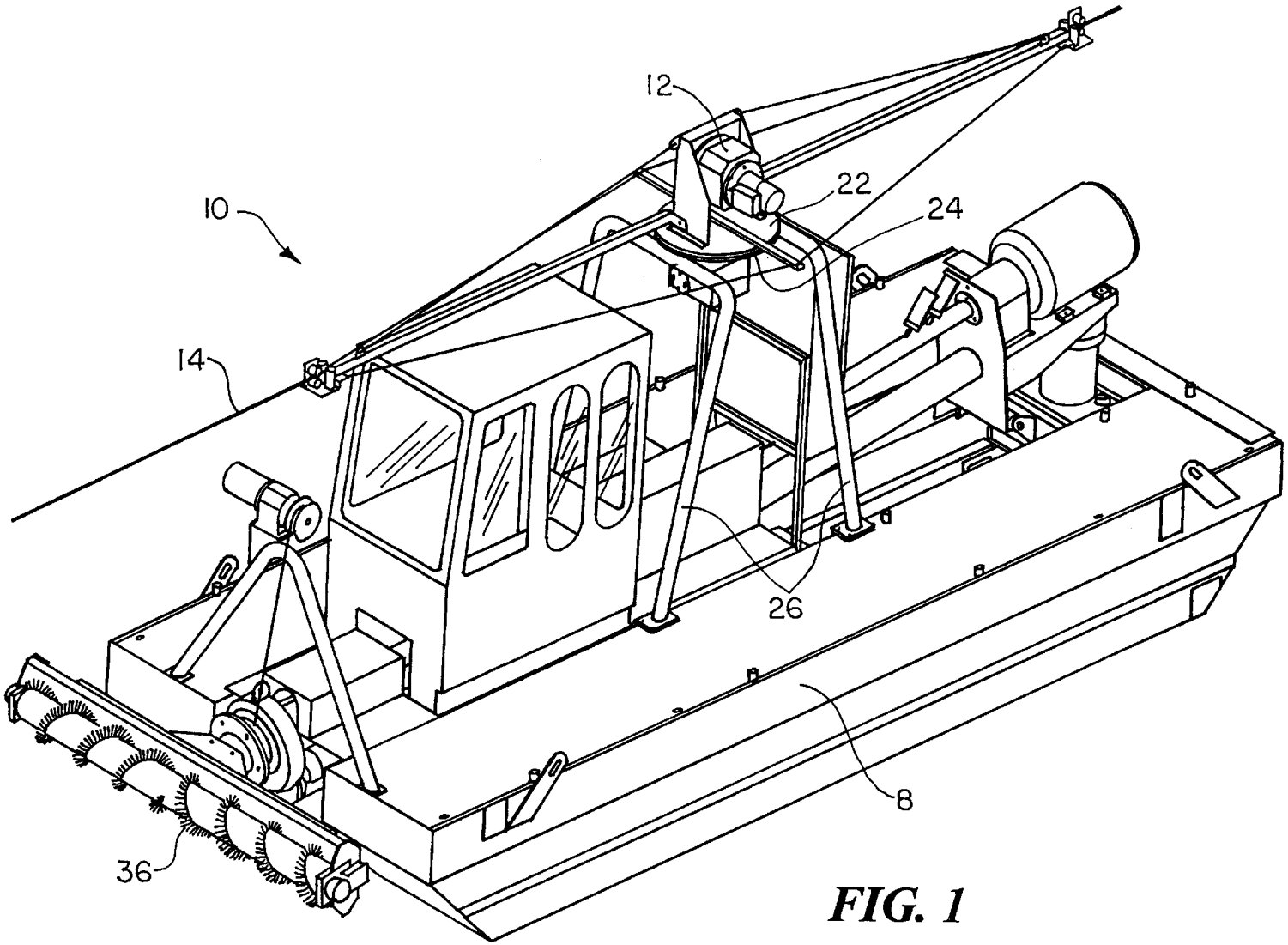
FIG. 1 is a perspective view of the dredge coupled to the pivoting winch apparatus.

Referring to FIG. 1., there is shown a dredging vehicle 10 operative to float on a body of water and driven by a transverse winch 12 on drive supports 26 attached to dredge frame 8. The dredging vehicle includes pontoons and a cutterhead which is extendable into an operational position at or near the waterbed. The vehicle is itself of generally known construction and operation. Winch 12 drives dredging vehicle 10 along an overhead cable 14. As the dredge 10 approaches the end of a pass, the dredge is pivoted 180 degrees as described below to effect the next pass in the opposite direction.

Figure 2:
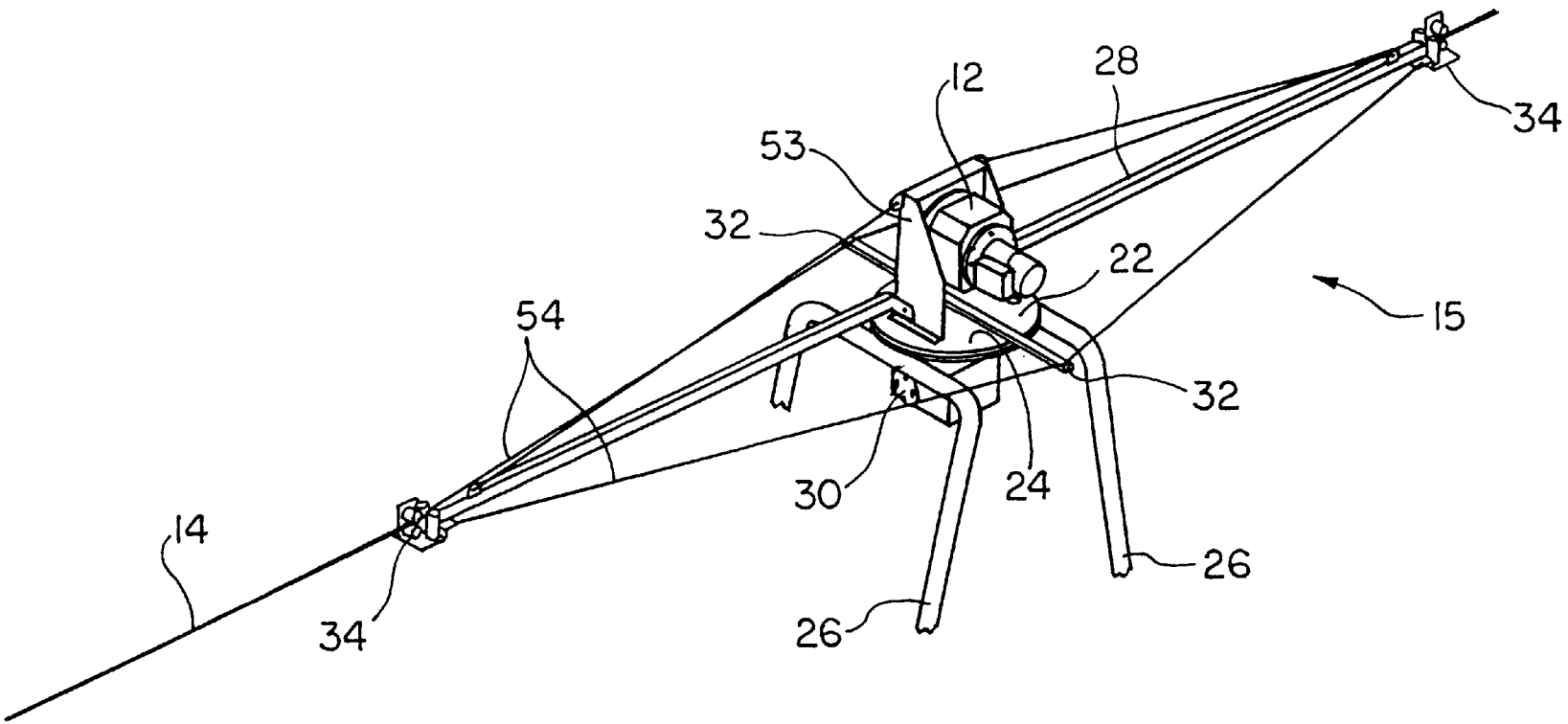
FIG. 2 is the pivoting winch apparatus.

Referring to FIGS. 1 and 2, the pivot mechanism is shown in more detail. Pivot mechanism 15 comprises an upper rotational plate 22 and a lower rotational plate 24. Upper plate 22 is attached to winch 12 and remains aligned with cable 14 via pivot arms 28. Lower plate 24 is in rotational communication with upper plate 22 and is rotated with respect to upper plate 22 by worm drive 30. As lower plate 24 is attached to drive supports 26 extending upward from the dredge frame 8, the dredge vehicle 10 is rotated with respect to the cable 14. Rotational torque of the winch 12 against cable 14 is absorbed by pivot arms 28. Pivot arms 28 are attached to winch housing 53, and in communication with cable 14 through guide rollers 34 attached to the ends of the arms 28. Pivot stabilizers 32 provide further support to pivot arms 28 by support cables 54 attached to guide rollers 34. Guide rollers 34 provide free movement of winch 12 along cable 14 by aligning upper plate 22 with the axis of the cable, thereby avoiding misalignment of the winch 12 with respect to cable 14.

As shown in FIGS. 3*a*–3*d*, a progression of dredging passes is shown. A dredging area 18 is dredged by dredge vehicle 10 by a series of successive transverse passes. At the end of each pass, the dredge is pivoted as above and cable anchors 16 moved laterally by a distance approximately the width of dredging head 36. In this manner, a series of parallel passes effects dredging of the entire area.

Figure 3B:
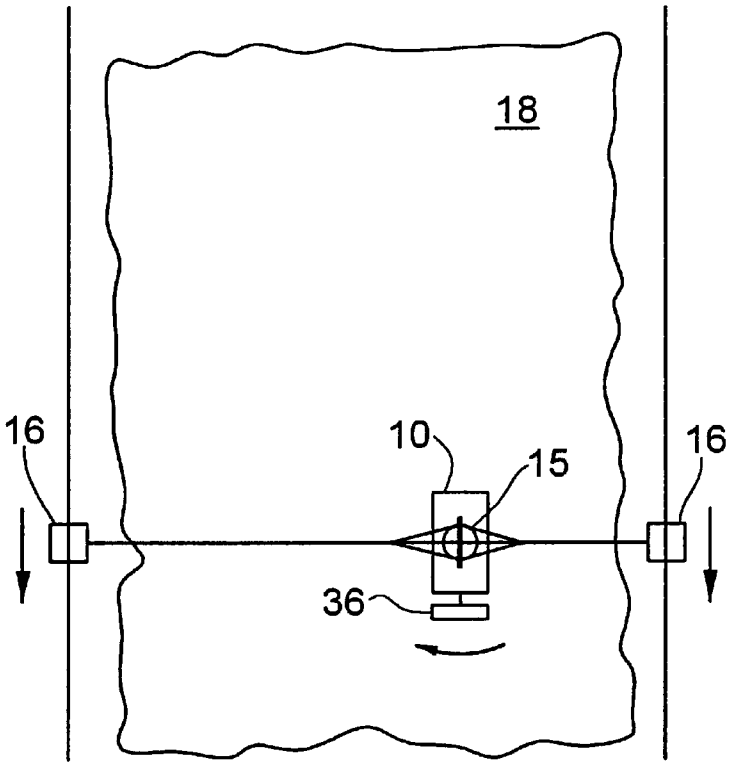
FIGS. 3*a*–3*d* are plan views of the dredge in successive passes across a dredging area.
Figure 3A:
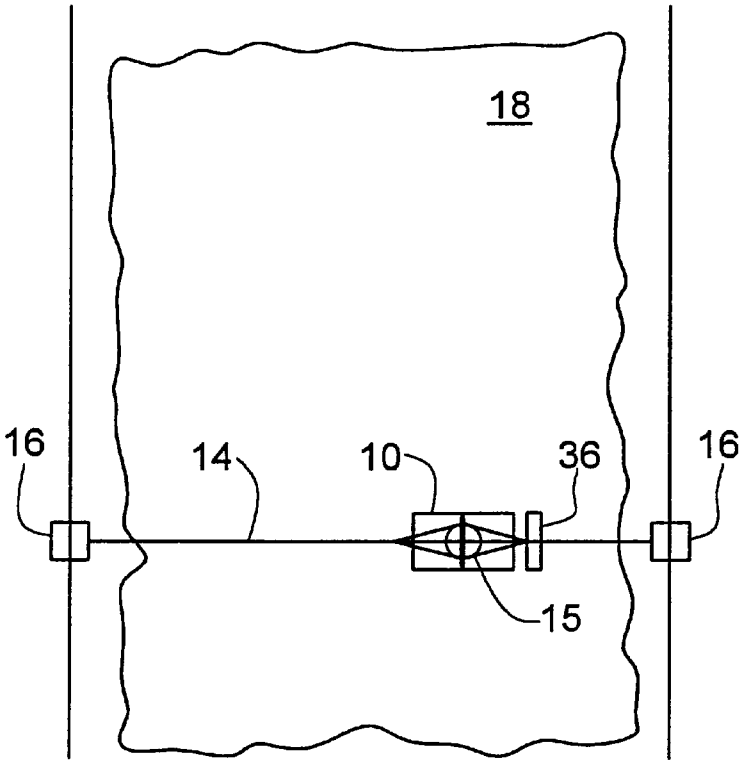
Figure 3D:
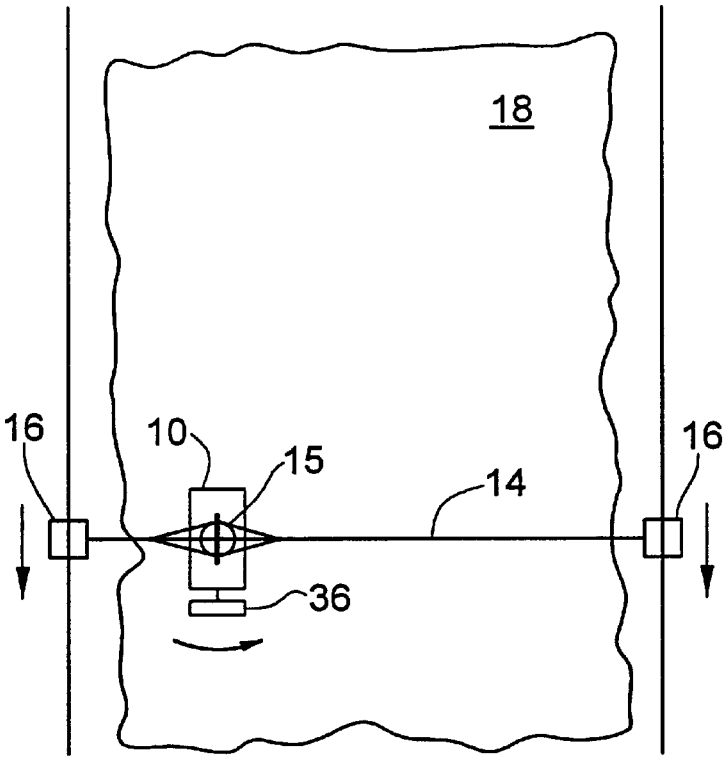
Figure 3C:
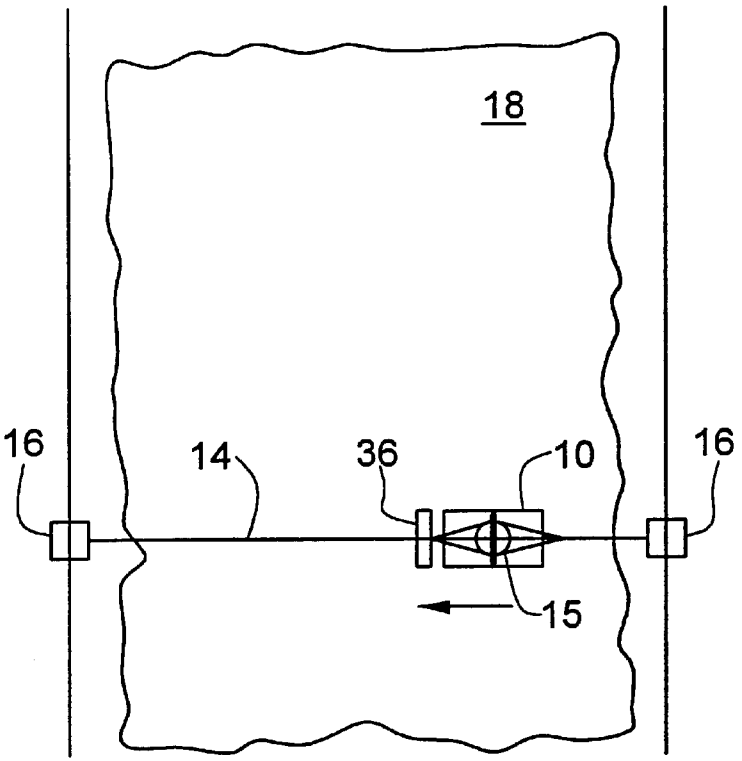

More specifically, referring to FIG. 3*a*, dredge vehicle 10 is approaching the end of a transverse pass. In FIG. 3*b*, the dredge 10 has reached the limit of the dredging area 18 and is pivoted 180 degrees by pivot mechanism 15. Cable anchors 16 are then moved laterally to position the next pass adjacent to the area covered by the previous pass. As shown in FIG. 3*c*, another pass in the opposite direction is effected as the dredge 10 is drawn along cable 14. Upon again reaching the limit of the dredging area 18 (FIG. 3*d*), dredge 10 is again rotated 180 degrees by pivot mechanism 15 to continue the next pass while cable anchors 16 are again disposed laterally a single pass width.

Figure 4:
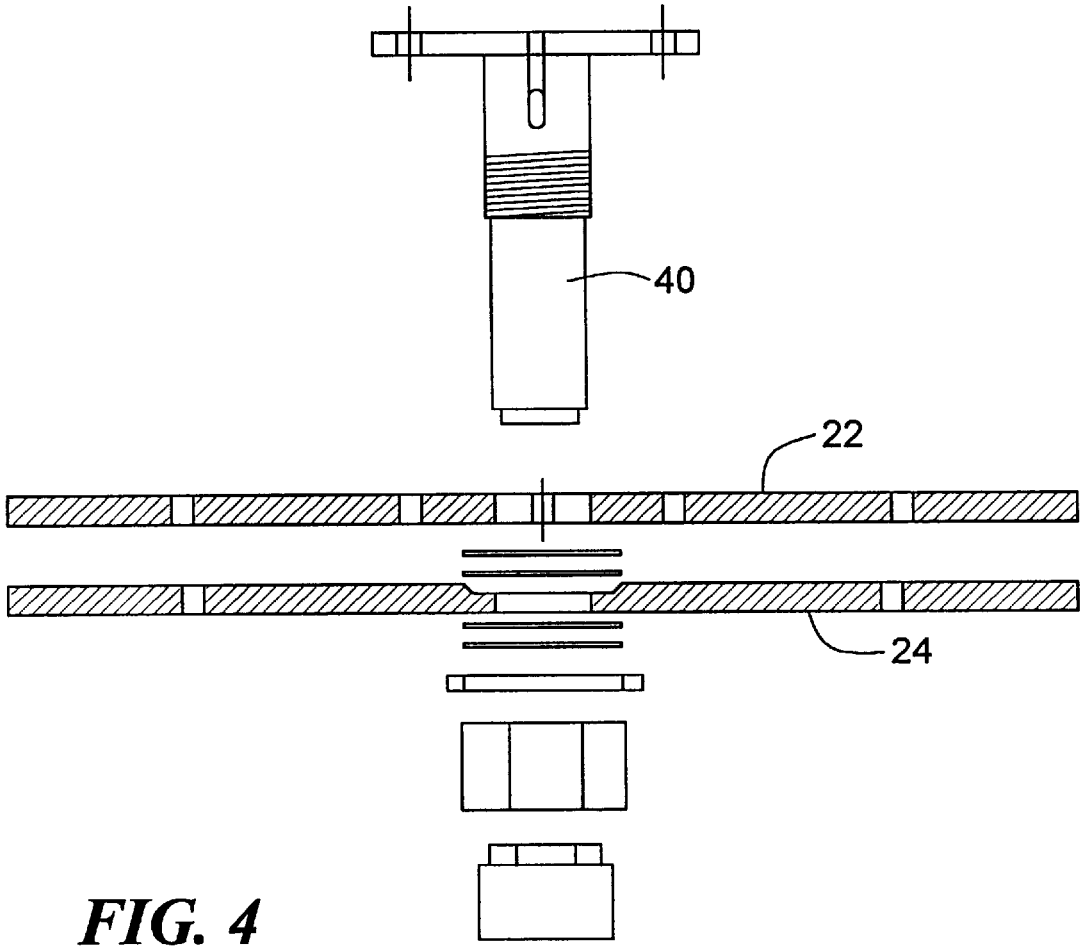
FIG. 4 is an exploded view of the rotational plates and shaft.
Figure 5:
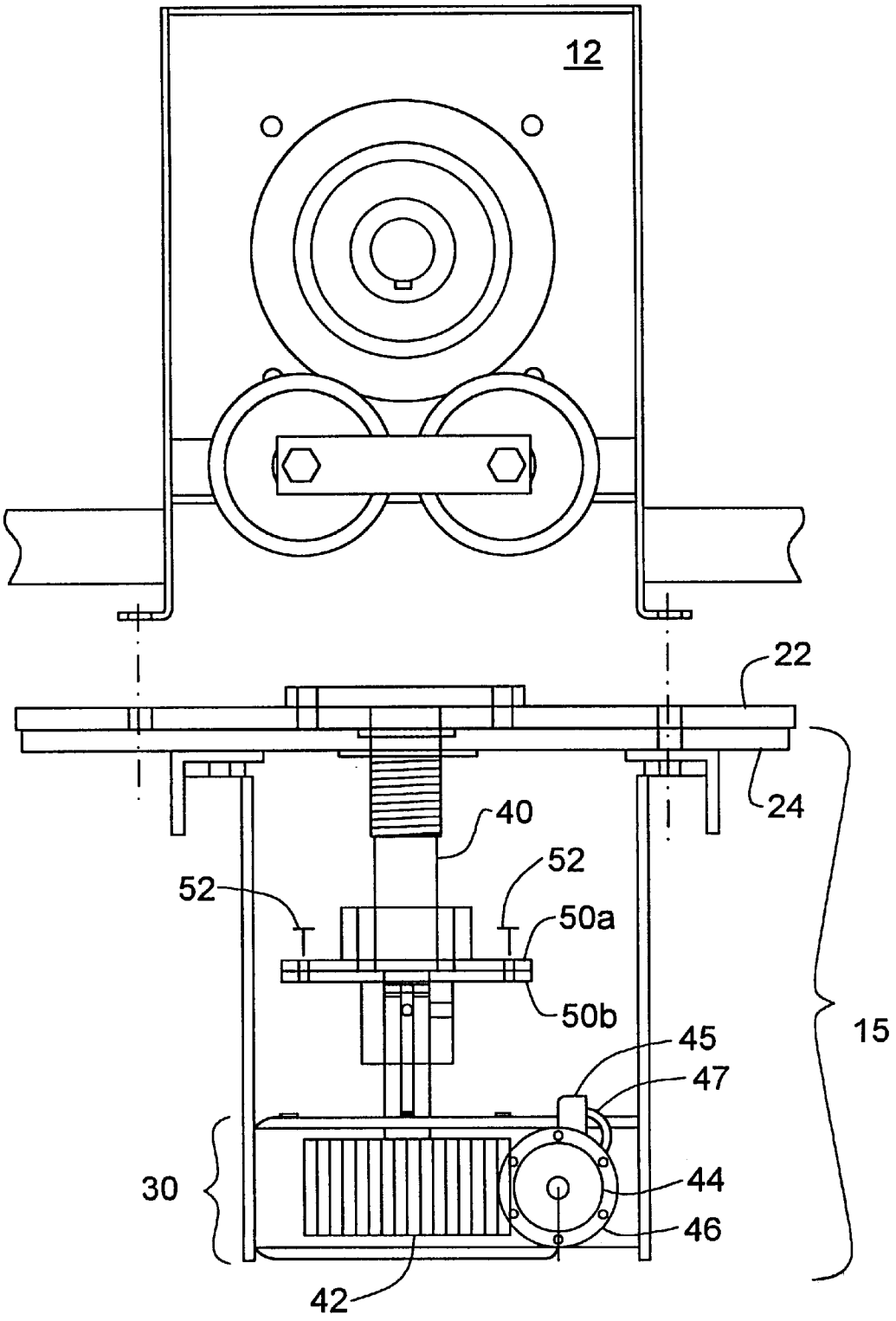
FIG. 5 is a side view of the pivot worm drive mechanism and rotational plates.

Referring to FIGS. 2 and 4, the pivot mechanism 15 in communication with transverse winch 12 is shown in more detail. Transverse winch 12 is fixed with respect to upper rotational plate 22 and is in communication with lower rotational plate 24 through shaft 40. Shaft 40 is also fixed with respect to upper plate 22 and in rotational communication with lower plate 24. Referring to FIG. 5, a gear 42 is attached to shaft 40, and worm drive mechanism 30 remains fixed with respect to lower plate 24. Pivot motor 46 powered by hydraulic circuit 47 and diverter 45 drives pivot worm screw 44 rotationally around gear 42, thereby pivoting lower plate 24 with respect to upper plate 22. In the preferred embodiment pivot motor 46 is powered by the same resource as winch 12, for example hydraulic, electric, or pneumatic, but could be any available drive source. Further, pivot mechanism 15 is shown as a worm assembly in the preferred embodiment, but could also be implemented by another mechanism effecting pivoting movement.

A further aspect of the invention is shown by shear plates 50*a* and 50*b*. Under ordinary operation, shear plates 50*a* and 50*b* are fixed with respect to each other by shear pins 52. In the event of an extreme torque applied to shaft 40 from, for example, submerged debris preventing free pivoting of the dredge vehicle 10, shear pins 52 are designed to sever. This shearing off will allow relative movement of shear plates 50*a* and 50*b* before the degree of torque increases sufficiently to damage pivot motor 46 or cause failure of pivot arms 28 and pivot stabilizers 32.

Figure 6:
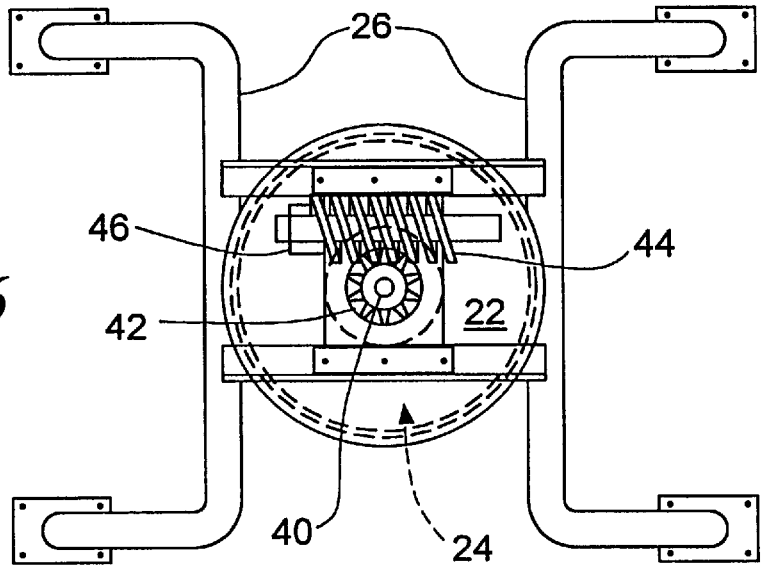
FIG. 6 is a plan view of the pivot worm drive mechanism and rotational plates.

Referring to FIG. 6, a plan view of the pivot mechanism is shown. Upper plate 22 is fixed with respect to shaft 40 and gear 42. Pivot motor 46 attached to lower plate 24 drives pivot worm screw 44 around gear 42, thereby effecting pivoting of lower plate 24 with respect to upper plate 22. As lower plate 24 is attached to drive supports 26, pivoting of the entire dredge vehicle is effected.

As the above description describes the preferred embodiment, various extensions and modifications to the presently disclosed invention will be apparent to those skilled in the art. Accordingly, the invention should not be viewed as being limited by the disclosed embodiments, but rather only by the spirit and scope of the following claims.

What is claimed is:

1. A bidirectional dredging apparatus comprising:

a dredging vehicle operative to float on a body of water and having a pivoting unit and a guide unit, said guide unit in connection with and substantially following a path defined by a guide cable wherein said guide unit provides propulsion along said guide cable by frictional communication with said cable;

said pivoting unit having a first rotational element fixed with respect to said guide unit, and a second rotational element fixed with respect to said dredging vehicle and rotational with respect to the first rotational element wherein said pivoting unit further comprises a pivot drive, said pivot drive effecting rotational movement of said second rotational surface with respect to said first rotational surface around a common axis through a shaft, said shaft further comprising a pair of shear plates in detachable coupling, said shear plates attached by at least one shear pin, said at least one shear pin having a predetermined severing point, wherein said pair of shear plates remain in fixed communication when said at least one shear pin is unsevered, and wherein said pair of shear plates are in rotational communication when said at least one shear pin is severed, and said pivoting unit is operable to pivot said dredging vehicle in a direction independent of said path defined by the guide cable.

2. Apparatus as in claim 1 wherein said pivot drive is powered hydraulically by a hydraulic circuit through a diverter;

said diverter having a threshold pressure; and wherein said diverter is activated when said threshold pressure is exceeded.

3. Apparatus of claim 1 wherein said pivot drive and said guide unit are connected to and powered by a common source.

4. Apparatus as in claim 1 further comprising a propulsion unit, said propulsion unit having a propeller and a propeller drive, wherein said propeller drive effects forward movement of said dredging vehicle.

* * * * *